US005337521A

United States Patent [19]

Heyl et al.

[11] Patent Number: 5,337,521

[45] Date of Patent: Aug. 16, 1994

[54] VALVE GRINDER

[75] Inventors: Derrick Heyl, Rollingstone; David M. Terpstra, Winona, both of Minn.

[73] Assignee: Hein-Werner Corporation, Waukesha, Wis.

[21] Appl. No.: 967,228

[22] Filed: Oct. 27, 1992

[51] Int. Cl.[5] ..... B24B 15/04

[52] U.S. Cl. ..... 51/105 VG; 51/98 R; 51/103 R; 51/236; 51/237 R; 51/241 VS; 279/43; 279/43.7; 279/46.7; 279/50

[58] Field of Search ..... 51/98 R, 98.5, 103 R, 51/105 R, 105 VG, 236, 237 R, 216 A, 217 A, 129, 241 VS; 279/2.03, 2.09, 2.1, 2.12, 2.18, 4.07, 4.09, 2.04, 43, 43.7, 46.7, 50, 51, 57, 146

[56] References Cited

U.S. PATENT DOCUMENTS

| | | | |
|---|---|---|---|
| 489,933 | 1/1893 | Conradson | 279/57 |
| 1,452,508 | 4/1923 | Hervig | 51/104 R |
| 1,533,133 | 4/1925 | Nickau | 51/105 VG |
| 1,722,880 | 7/1929 | Albertson | 51/237 R |
| 2,221,918 | 11/1940 | Hall et al. | 51/105 |
| 2,413,678 | 1/1947 | Beverlin | 279/4.09 |
| 2,471,921 | 5/1949 | Ashdown | 279/146 |
| 2,491,358 | 12/1949 | Bogart | 279/146 |
| 2,567,320 | 9/1951 | Christensen | 51/103 R |
| 3,022,082 | 2/1962 | Haviland | 279/46.7 |
| 3,025,646 | 3/1962 | Thompson | 279/46.7 |
| 3,802,713 | 4/1974 | Levy | 279/50 |
| 4,228,621 | 10/1980 | Wagor | 51/241 |
| 4,428,160 | 1/1984 | Willemsen et al. | 51/129 |
| 4,612,735 | 9/1986 | Millay et al. | 51/217 A |
| 4,930,261 | 6/1990 | Tiegs et al. | 51/105 |
| 5,070,653 | 12/1991 | Amundson | 51/105 |

FOREIGN PATENT DOCUMENTS

| | | | |
|---|---|---|---|
| 360197306 | 10/1985 | Japan | 279/50 |

OTHER PUBLICATIONS

Drawing dated Feb. 2, 1955 showing a valve regrinder wherein valve is driven and held in place with center pulley.

*Primary Examiner*—Jack Lavinder
*Attorney, Agent, or Firm*—James A. Wilke

[57] ABSTRACT

Valve grinder comprising a grinding wheel mounted on a bench, said bench also having a surface for supporting a valve stem support stand mounted a spaced distance from said grinding wheel, said valve stem support stand comprising a pair of V-blocks and valve bearings for engaging the valve stem and an end stop. Mounted on said surface by a tandem axis pivot is a chuck for gripping the valve stem, said chuck including a positive clamping collet that engages the valve stem annularly with a plurality of contact points when the collet is squeezed between a collet spool and collet cover by a collet fork. Said chuck further rotates the valve while maintaining the positive clamping on the valve stem during the grinding operation but independently of the valve support stand.

10 Claims, 5 Drawing Sheets

VALVE GRINDER

FIELD OF THE INVENTION

This invention relates to a valve grinder for grinding the beveled face of a valve head while rotating the valve about its stem's long axis and more particularly to the apparatus for driving and securing the valve in the grinder device.

BACKGROUND OF THE INVENTION

An engine or a compressor pump has one or more cylinders, each which has a number of valves needed for the proper operation of the engine. Typically, at least one valve is for an input port and one valve is for an output port. The valves are seated in an opening in the engine block such that the beveled face of the valve head mates with a like beveled face in the valve seat. Proper fitting of the two faces is important for proper operation of an engine. Over time the beveled face of the valve head becomes worn or pitted and must be either repaired or the valve discarded. The use of the present invention provides the machinery for performing the necessary grinding of the valve face and the valve stem's end so that the valve can be returned to operation within an engine.

The angle of bevel on the seating surface must be determined and set on the grinding device as a prelude to the grinding operation. The valve stem usually has a smooth area on a length of the stem between the valve head on one end and the distal end of the valve stem on the other end. The length will vary based on the valve application. The valve typically has a head, a stem and an end. The head is a round flat surface perpendicular to the axis of the stem and the head has an annular side surface (called the seating face) beveled toward the stem. The end of the valve stem opposite the head, the distal end, must be first ground flat and perpendicular to the axis of the valve stem.

The beveled seat grinding operation is accomplished by a grinding wheel rotating at a selected speed and engaging the seating face of the valve at the proper bevel angle while the valve is rotating, at a selected speed, preferably in a direction opposite to the rotation of the grinding wheel.

During the grinding operation, the maintenance of the length of the valve between the valve head surface and the distal end, the bevel angle, non-distortion of the valve, the relative constant speed and direction of rotation of the valve against the grinding wheel are important in order to be able to obtain a proper finish on the valve seat face and to prevent run-out of the valve. Run-out is the difference in concentricity along the axis of the machined surface of the valve head and the valve stem. In the prior art various machines have been patented to address these concerns. The Willemsen, et al patent U.S. No. 4,428,160 uses three rollers, two of which are driven, to rotate the valve and provide a part of the clamping function. The Willemsen device uses a separate air driven hold down member to provide a clamping action on the valve stem. The Amundsen U.S. Pat. No. 5,070,653 device uses a drive wheel for rotating the valve stem forcing the valve into the V-block supports and drawing the seating face into contact with the grinding wheel. The Wagor, U.S. Pat. No. 4,228,621 and this Applicant's Assignee's U.S. Pat. No. 4,930,261 devices show the valve being gripped on one end by a driven chuck. The Serdi Corp., U.S.A. shows in its sales literature, a valve refacing machine that vertically supports the valve stem and rotates the valve by driving the valve with a frictional pad on the valve head's surface. Another method of securing and driving the valve in a grinding device is to pull the valve stem against two spaced apart supports relying on friction to maintain the valve's position during the grinding operation.

The prior art devices rely on maintaining the valve in the proper grinding position by using the valve rotating means as a part of the valve clamping device, such as in the Willemsen and Amundsen devices and the last described method in the prior paragraph or one end or the other of the valve is driven to provide rotation and/or clamping as in the Wagor, Applicant's Assignee and Serdi disclosures. Those prior art devices, in addressing one problem, create other problems such as drawing the valve sideways or moving the valve out of its support cradle during the grinding operation.

SUMMARY OF THE PRESENT INVENTION

The valve grinder apparatus of the present invention is designed to support the valve during the grinding operation independently of the manner used to inpart the rotation motion to the valve during the grinding operation.

The valve stem is supported by two V-block supports mounted on an indexed surface and a valve bearing clamping the valve stem to each of the V-blocks.

The valve bearing is mounted on a reciprocating fluid actuated cylinder and biases the valve stem against the V-block but also allows the valve stem to rotate. The V-blocks are mounted, independently, on an indexed bed plate and such blocks can be slidably moved into position along the valve stem at a convenient location, typically at the extreme opposite ends of the smooth surface of the valve stem. The indexed bed plate is moved toward and away from the grinding wheel as well as rotated to set the bevel angle needed to properly grind the seating face of the valve head.

The valve is rotated during the grinding operation by a free floating or movable chuck for gripping the valve stem at a location along the stem between the V-blocks. The gripping is accomplished by a positive clamping collet maintained in a plane perpendicular to the longitudinal axis of the valve stem by a pair of parallel, coaxial rotating bearings. The valve stem is extended into and through the collet. A collet fork is mounted on the mounting plate and pivoted to push one of the rotating bearings toward the other rotating bearing which is secured in a mounting plate. The motion of the bearings toward each other force the collet, which is in the shape of a truncated cone, into a through bore in both bearings thereby compressing the positive clamping collet and securing the valve stem in the chuck until such time as the pressure on the collet fork is released after the grinding operation. Pressure is maintained on the collet fork during the grinding operation. The chuck gripping the valve stem is rotated by a pulley belt transmission attached to a drive motor mounted on the mounting plate.

Another unique feature of the valve grinding apparatus of the present invention is a tandem axis pivot used to mount the driving mechanism including the drive motor and valve chuck, to the support structure that carries the said valve support V-blocks.

One bearing mounted axle in the tandem axis pivot is attached to the mounting plate supporting the drive mechanism and the other bearing mounted axle is attached to a plate mounted on the support structure. This tandem axis pivot allows the chuck to maintain a grip on the valve stem, in a perpendicular aspect, during the grinding operation and allow a double axis of rotation for the mounting plate during the grinding operation.

A major feature of the present invention is that the support for the valve stem, during the grinding operation, is independent from the means for gripping and rotating the valve stem, thereby eliminating side load to the valve stem which tends to distort the valve stem during the grinding operation.

Another major feature of the present invention is the positive clamping affected by the chuck for rotating the valve thereby eliminating slippage and wobble during the grinding operation.

An additional major feature is the tandem axis pivot that allows motion of the chuck and valve driving motor, during the grinding operation, in all directions, except the direction perpendicular to the valve stem.

Figure 1:
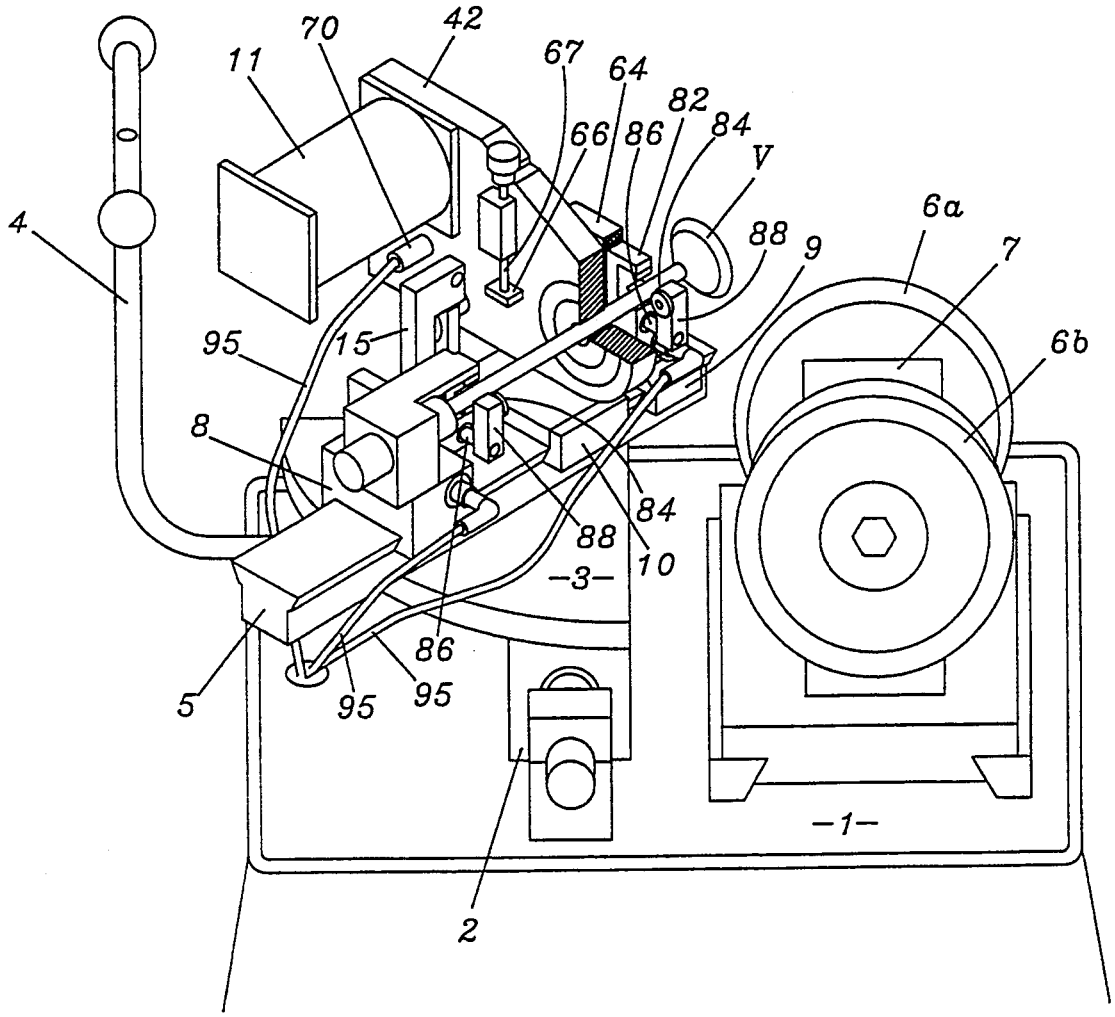
FIG. 1 is a plan view of a valve grinder embodying the invention and showing an engine valve secured in the chuck.

Before explaining at least one embodiment of the invention in detail it is to be understood that the invention is not limited in its application to the details of construction and the arrangement of the components set forth in the following description or illustration in the drawings. The invention is capable of other embodiments on being practiced or carried out in various ways. Also, it is to be understood that the phraseology and terminology employed herein is for the purpose of description and should not be regarded as limiting.

DETAILED DESCRIPTION OF THE PREFERRED EMBODIMENT

The valve grinder apparatus embodying the invention is illustrated in the drawings. A valve V, as shown in FIG. 1, has a valve head with an annular seating face and a stem with a smooth surface between the valve head and the distal end of the stem. The valve grinder apparatus is supported by a bench 1 of sufficient size and strength to accommodate the invention, motor, controls and assorted tools necessary to grind a valve. Mounted on the bench is a grinding drive motor 7 which has attached to it one or more grinding wheels. Said drive motor and grinding wheels may be selectively positioned to contact the valve face for the grinding operation. FIG. 1 illustrates a grind wheel *6a* for grinding the beveled face of the valve head and a grind wheel *6b* for grinding the distal end of the valve stem. The present invention is mounted on a support surface 3 which is attached to the bench 1 by a suitable means for holding the support surface such as a hinge assembly 2. A handle 4 is attached to the support surface 3 and is used to move the secured valve through a path and across the face of the grinding wheel *6a*.

Figure 2:
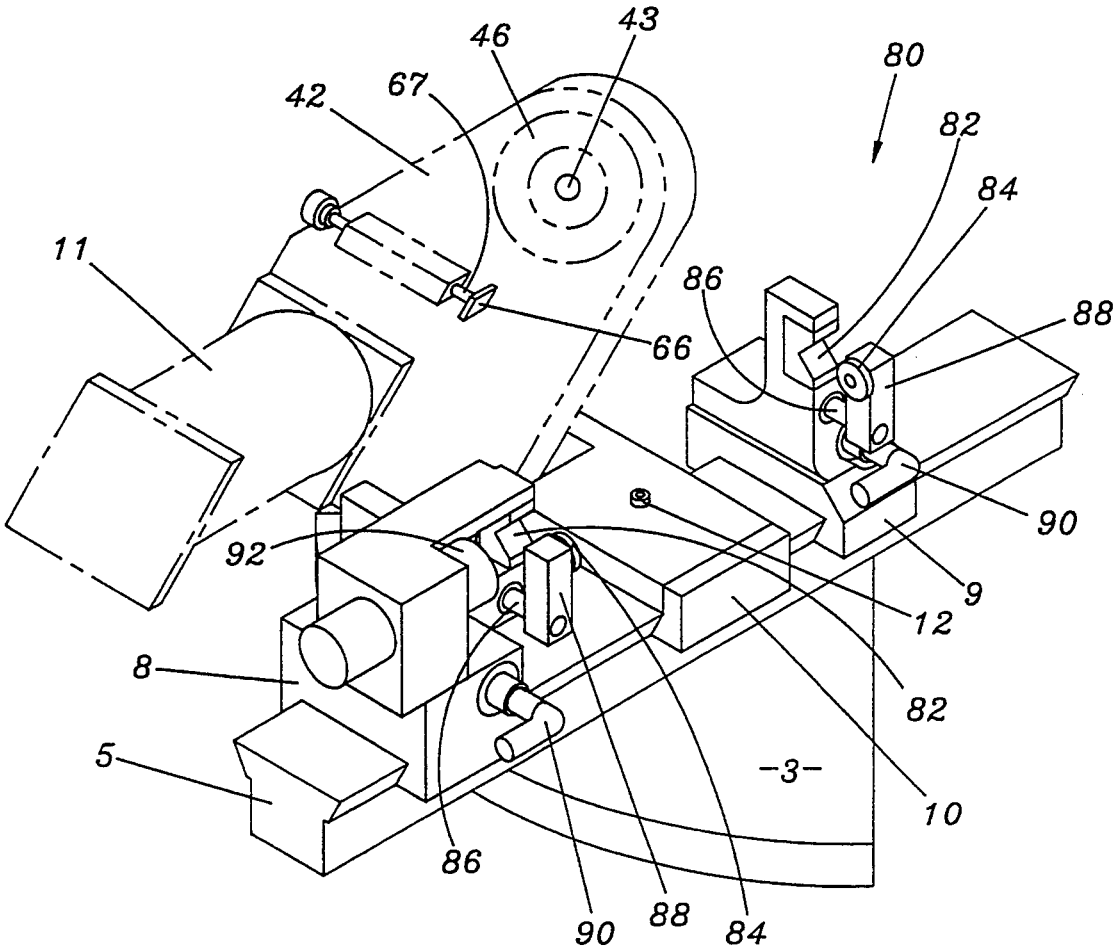
FIG. 2 is a plan view of the valve stem support stand with the chuck shown in phantom lines for reference.

Referring to FIG. 2, a valve stem support stand 80 includes an indexed bed plate 5, which supports a back carriage 8, a front carriage 9 and a support structure 10. The carriages 8 and 9 and the support structure 10 can be moved along the bed plate 5 to selected positions to accommodate the length of valve stem involved in the grinding work. Said bed plate 5 is used to adjust the angular relationship between the valve V and the grinding wheel *6a*.

Figure 3:
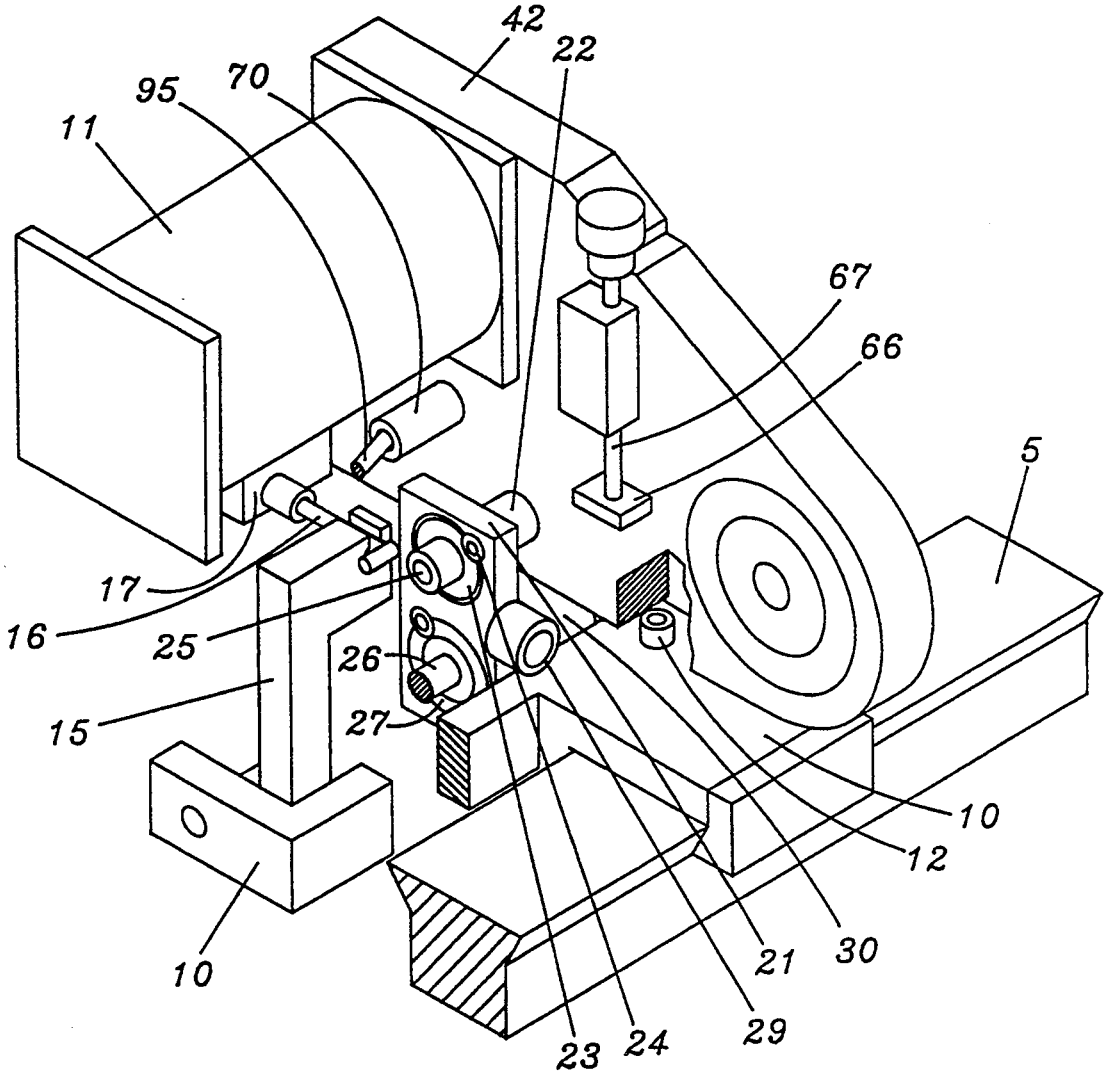
FIG. 3 is a plan view of the tandem axis pivot supporting the chuck mounting plate and mounted on the support structure.

FIG. 3 shows the tandem axis pivot 20 connected to the support structure 10 and to a drive mechanism plate 42. The tandem axis pivot is a pivot plate 21 which as illustrated has a substantially rectangular shape. The pivot plate has at least two ring bearings mounted on axle rods in bores in the plate, which bores have parallel axes. Mounted in each bore is a ring bearing 23 and 27 and secured therein by a bearing set screw 24. Each ring bearing engages an axle rod 22 and 26. In the preferred embodiment, the drive plate bearing 23 is mounted on the first axle rod 22 with the axle rod secured thereon by an end cap 25 and the other end of said axle rod is pivotally engaged in the drive mechanism plate 42. The drive support bearing 27 is mounted on the second axle rod 26, which axle rod is pivotally mounted between two fingers of the support structure 10. Said second axle rod is provided with a double acting pivot fluid cylinder and piston 30 mounted between the pivot plate 21 and the support structure 10 such that the fluid cylinder exerts a force, along the longitudinal axis of the second axle rod 26, against the pivot plate 21. The purpose of such force against the said pivot plate is to maintain the distal end of the valve V against the stop 92 mounted on the back carriage 8 and will be more fully described below. A drive guide pin 12 is fixed to the mounting structure 10 at a position to butt against the drive mechanism plate 42 when said plate is in its relaxed position. The pivot plate 21 also has a pivot bumper 29 mounted perpendicularily to the axle rod 26 and contacts the support structure 10 when the drive mechanism plate 42 is in its operative position as shown in FIG. 2. When the drive mechanism plate 42 is not in the operative position, as shown in FIG. 2, such plate can be tipped back. To prevent such plate from tipping too far, a restraint sub-assembly is attached between the drive plate 42 and the support structure 10. The restraint sub-assembly consists of a cable post 15 mounted on the support structure 10 and a fluid cylinder and piston 17 mounted on the drive mechanism plate 42 with a cable 16 attached to the piston of the fluid cylinder and the cable post 15. The length of said cable 16 will determine the distance of tip-back of the drive mechanism plate 42. In operation, when the air cylinder and piston is activated, the cable 16 is drawn taut thereby restraining the drive mechanism plate; during the grinding operation, the cable is slack so that the drive mechanism plate 42 is free to move on the tandem axis pivot 20 in accord with this present invention.

The valve V is gripped and rotated during the grinding operation by a chuck assembly 40, said chuck assembly includes a pair of rotating bearings, a plurality of bearing races and snap rings, a collet spool and cover and a positive clamping collet. The chuck assembly 40 will be described more fully below. As the valve is ground it is important that the chuck firmly grips the valve and does not allow it to slip. Slippage of the valve during the grinding operation will cause the beveled face to have waves or flat spots and will prevent the beveled valve face from being concentric with the valve stem longitudinal axis. Failure to be so concentric is called "run-out", with the least amount of run-out preferred The present invention avoids slippage of the valve by positively engaging the valve stem, on its stem surface, annularly with a plurality of contact points. Such engagement is accomplished by a positive clamping collet incorporated into the present invention as hereinafter described.

Figure 4:
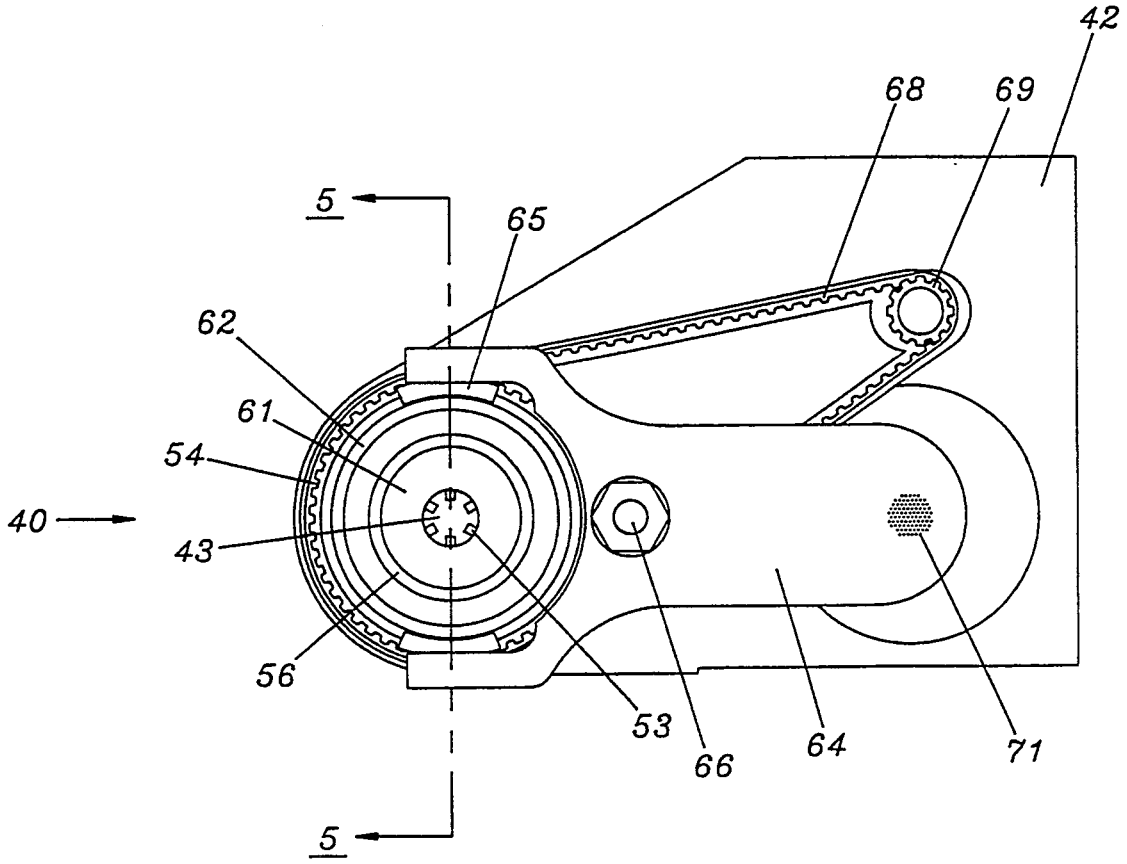
FIG. 4 is a left elevation end view of the chuck showing the collet fork and drive pully.
Figure 5:
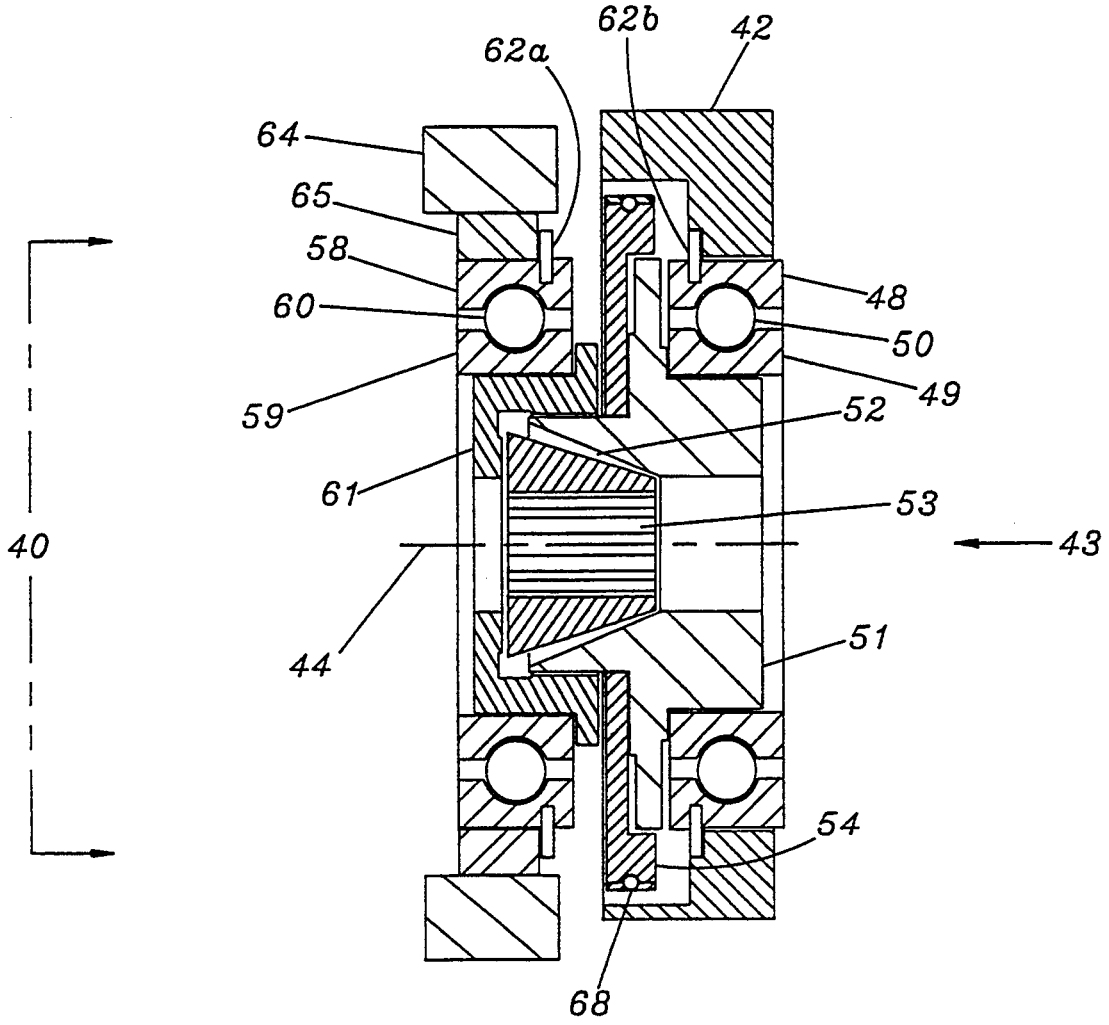
FIG. 5 is a cross sectional view of the chuck taken along the line 5—5 in FIG. 4.

Referring to FIGS. 3, 4, and 5—5, the valve chuck assembly 40 and the drive motor 11 are operatively attached to a drive mechanism plate 42. The drive mechanism plate is pivotally mounted on the tandem axis plate 21 by the first axle rod 22. The drive mechanism plate 42 has a through bore 43 along the bore axis line 44 and said through bore 43 is sized to receive the chuck assembly 40. The chuck assembly 40 is mounted in said bore and can be seen in FIG. 5—5 which is a cross sectional view of the chuck. A first rotating bearing 46 consisting of a plurality of ball bearings 50 contained between an outer race 48 and an inner race 49 that circumscribes and engages one side of a collet spool 51. An annular pressure ring **62*b* circumscribes the outer race 48 of said rotating bearing 46. Said collet spool has a frustoconical bore 52 adapted to receive a positive clamping collet 53 having a corresponding frustoconical shape. It should be noted that the positive clamping collet may be of any suitable shape that will deform sufficiently to positively engage the valve stem. A drive pulley 54 circumscribes and engages the side of the collet spool 51 opposite the said side engaging the first rotating bearing 46. Said first rotating bearing 46 and collet spool 51 are substantially contained in the said drive mechanism plate 42. A second rotating bearing 56 consisting of a plurality of ball bearings 60 contained between an outer race 58 and an inner race 59 that circumscribes and engages a collet cover 61, with said collet cover adapted to contact said positive clamping collet 53. The said outer race 58 of the second rotating bearing 56 is circumscribed with an annular pressure ring 62*a*. The annular pressure rings 62*a* and 62*b*** may be a snap ring or a shoulder integral with the outer race.

The second rotating bearing and collet cover subassembly is engaged by a collet fork 64. The collet fork is an elongated member having two tines on one end. Mounted on a face of each tine is a pressure dog 65 so that the pressure dogs are in juxtaposition to each other with the surface of the pressure dog facing each other contoured to the radius of the outer race 58 of the second rotating bearing 56. The collet fork 64 is removably attached to the drive mechanism plate 42 by a pivot attachment bolt 66 extending through the collet fork and said plate. The pivot attachment bolt is locked in place by a means to secure the pivot attachment 67 such as a sliding rod as shown in FIGS. 1 and 3. The end of the collet fork 64 opposite the tines is in engagement with a piston and fluid cylinder 70 at a detent 71 (shown with phantom lines in FIG. 4) with the fluid cylinder 70 mounted on the drive mechanism plate 42 and the fluid piston (not shown) extending through said plate to engage the collet fork.

The drive motor 11 is mounted on the drive mechanism plate 42 in a convenient manner with a motor pulley 69 attached to the drive motor. The motor pulley 69 is aligned with and oplaner with the drive pulley 54 with the said pulleys connected to each other by a pulley belt 68. In the preferred embodiment, the pulley belt is a toothed belt, but such belt may be of any suitable material and construction capable of retarding slippage.

In operation, the fluid cylinder 70 is activated thereby pushing the fluid piston against the collet fork 64 which moves the collet fork end away from the drive mechanism plate 42 as the collet fork pivots on the pivot attachment 66. The end of the collet fork having the pressure dogs 65 mounted on the tines is moved toward the drive mechanism plate 42 by the said pivot action. The pressure dogs 65, in engagement with the second rotating bearing 56 push against the pressure ring **62*a* thereby pushing the second rotating bearing 56 and collet cover 61 subassembly against the positive clamping collet 53. As a result of the frustoconical shape of the said collet 53 and the corresponding shape of the bore 52 in the collet spool 51, as the collet cover 62 pushes the collet 53 into the collet spool 51, the collet deforms thereby compressing and reducing the diameter of the collet and the through bore 43 in the collet 53**. As a result the collet will positively clamp the valve stem annularly with a plurality of contact points. The collet used in the illustrated invention is made of resilient material with elongated metal strips inbedded therein and forming a substantially cylinderial shaped interior bore and having a frustoconical exterior shape.

While the valve V is rotated, during the grinding process, by the chuck 40, the valve is positioned by the valve stem support stand 80 as illustrated in FIGS. 1 and 2. The back carriage 8 and the front carriage 9 each have mounted thereon a V-block 82. Each carriage is independently mounted on an indexed bed and can be moved toward or away from each other a distance sufficient to support the valve V, in the V-blocks, along the smooth surface of the valve stem. The valve stem is maintained in the V-block by a valve bearing 84 contacting the valve stem and biasing the valve stem against said V-block resulting in a three point support at two locations along the valve stem. The V-block comprises a support surface that has at least two tangential support points. The illustrated V-block consists of two planar members defining an acute angle, however, such tangential supports may be circular, spherical or eliptical. The valve bearing 84 is mounted on one end of a valve bearing support 88 which is mounted on a valve bearing rod 86. The valve bearing rod is connected to a fluid cylinder 90 which provides a reciprocating motion to the valve bearing support. When the fluid cylinder is activated, it draws the valve bearing toward the V-block and maintains the valve bearing against the valve stem until the fluid cylinder is deactivated. Fluid is supplied to all fluid cylinders by suitable fluid lines 95 attached to a suitable fluid supply (not shown). The back carriage 8 also has an end stop 92 mounted horizontally and perpendicularily to the longitudinal axis of a valve stem located in the V-blocks. The end stop 92 can be selectively positioned in conjunction with the positions of the said carriages to correspond to the appropriate length of the valve stem. The entire valve stem support stand 80, the chuck 40 and the support surface 3 is moved a spaced distance toward the grinding wheel 6a during the grinding procedure.

The five fluid cylinder and piston sets, 17, 30, 70 and 90 (twice) are of conventional type and well known in the art, however, an important aspect of the present invention is the sequence of activation of such fluid cylinder and piston sets. The activation of the two fluid cylinders 90 in the back and front carriages and the deactivation of the fluid cylinder 17 occur substantially simultaneously after the valve V is inserted in the chuck 40 so that the distal end of the valve stem contacts the end stop 92 and the V-blocks 82 are aligned along the ground surface of the stem, thereby biasing the valve stem against said V-blocks. Fluid cylinder 17 is deactivated to allow the free movement of the valve in the V-blocks 82. Then the fluid cylinder 70 for the chuck is activated thereby positively clamping the valve stem in the chuck. The fluid cylinder 30 is activated moving the entire drive mechanism plate 42 laterally to maintain the distal end of the valve in engagement with the end stop 92. After the grinding operation is completed, the sequence is reversed and the valve removed from the apparatus. The sequencing of the fluid cylinders can be accomplished by manual fluid switches, pressure switches and by a plurality of fluid accumulators of a conventional type. The switches and accumulators are inserted in the fluid lines 95 between the respective fluid cylinder and the fluid supply. The fluid used in this invention may be air, compressed gas or non-compressive liquid. Any electric and fluid controls and switches for the valve grinder may be conveniently located and mounted.

The apparatus, for esthetic and safety purposes, is enclosed in an appropriate housing thereby shrouding the various portions of the apparatus in a convenient manner.

It should be apparent that there has been provided in accordance with the present invention a valve grinder and method that fully satisfies the aim, objects and advantages set forth above although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A valve grinder apparatus mounted on a surface including a grinding wheel for grinding a valve having a stem with a valve head having an annular seating face on one end of the stem and a distal end opposite the valve head, said stem further having a length of smooth surface between said valve head and said distal end, said valve grinder apparatus comprising:

a means for driving the grinding wheel at selected speeds, said means mounted to said surface, a valve stem support stand including an indexed bed plate a spaced distance from said means for driving the grinding wheel, said valve stem support stand comprising a support structure slidably mounted on the indexed bed plate between a pair of V-blocks independently, slidably mounted on the indexed bed plate a distance apart from each other to support and cradle the valve stem along the smooth valve stem surface, each V-block further having a valve bearing mounted on a valve bearing support and said valve bearing support mounted on a rod with said rod connected to a means for moving the valve bearing into contact with the valve stem and biasing said valve stem against the V-block, and an end stop member slidably mounted on one of said V-blocks, a drive mechanism plate having a through bore, pivotally attached to the support structure, a chuck assembly for gripping the valve stem, said chuck assembly comprising:

a first rotating bearing mounted on a collet spool in the drive mechanism plate co-axially with the through bore and having a drive pulley attached to said collet spool, and a positive clamping collet inserted into said through bore and maintained in said through bore by a collet cover circumscribed by a second rotating bearing, which bearing has an annular pressure ring, said collet further adapted to positively clamp the valve stem when pressure is applied to the annular pressure ring thereby compressing said collet into engagement with said valve stem, a collet fork having two opposing, faced tines, which fork is pivotally attached to the drive mechanism plate by a pivot attachment and having a pressure dog mounted on each face of opposing tines which are adapted to engage the second rotating bearing and apply pressure to said pressure ring when the collet fork is tilted about the pivot attachment, a means for tilting the collet fork toward the drive mechanism plate thereby pushing the pressure dogs against the pressure ring and toward the first rotating bearing and compressing the positive clamping collet, a means for restraining the drive mechanism plate mounted on said drive mechanism plate and attached to the support structure, a drive motor mounted on the drive mechanism plate and in engagement with the drive pulley on the collet spool, and a means for indexing the valve stem support stand a spaced distance from the grinding wheel and mounted on said surface.

2. The valve grinder apparatus of claim 1 wherein the positive clamping collet is a resilient material having a central cylindrical bore.

3. The valve grinder apparatus of claim 2 wherein the positive clamping collet has a frustoconical shape.

4. The valve grinder apparatus of claim 2 wherein the central cylindrical bore is further defined by a plurality of metal elongated strips imbedded in the resilient material.

5. The valve grinder of claim 1 including a means for moving the chuck assembly and drive mechanism plate with respect to said end stop.

6. The valve grinder apparatus of claim 1 wherein each of the means for moving the valve bearing in each V-block, the means for tilting the collet fork, and the means for restraining the drive mechanism plate is an independent, fluid activated cylinder and piston.

7. The valve grinder apparatus of claim 6 including a means for sequencing the activation of each said fluid activated cylinder and piston.

8. The valve grinder apparatus of claim 7 wherein the means for sequencing is a fluid accumulator and fluid pressure switch located between a fluid supply and the said respective fluid cylinder and piston in a fluid line connecting said fluid supply and fluid cylinder.

9. The valve grinder apparatus of claim 6 wherein the fluid used in the cylinder and piston is one selected from a group consisting of air, compressed gas and incompressible liquid.

10. The valve grinder apparatus of claim 1, wherein the drive mechanism plate is perpendicular to the stem of the valve.

* * * * *